US010741939B1

(12) United States Patent
Nikolopoulos et al.

(10) Patent No.: US 10,741,939 B1
(45) Date of Patent: Aug. 11, 2020

(54) SAFETY HOUSING FOR ALLIGATOR CLIP USED IN HIGH AMPERAGE ELECTRICAL APPLICATIONS

(71) Applicant: Eagletree-Pump Acquisition Corp., New York, NY (US)

(72) Inventors: Konstantinos Nikolopoulos, Lodi, NJ (US); Raphael Sagher, Alpine, NJ (US)

(73) Assignee: EAGLETREE-PUMP ACQUISITION CORP., New York, NY (US)

( * ) Notice: Subject to any disclaimer, the term of this patent is extended or adjusted under 35 U.S.C. 154(b) by 0 days.

(21) Appl. No.: 16/373,826

(22) Filed: Apr. 3, 2019

(51) Int. Cl.
*H01R 11/24* (2006.01)
*H01R 4/70* (2006.01)

(52) U.S. Cl.
CPC ..... *H01R 11/24* (2013.01); *H01R 4/70* (2013.01)

(58) Field of Classification Search
CPC ..... H01R 1/24; H01R 4/70; H01R 13/62961; H01R 13/635; H01R 13/6335; H01R 11/18; H01R 4/48; H01R 4/4845
USPC .... 439/752, 159, 160, 372, 476.1, 867, 131, 439/482, 729, 789, 816, 822
See application file for complete search history.

(56) References Cited

U.S. PATENT DOCUMENTS 1,965,151 A * 7/1934 Mueller ..... H01R 11/24 439/744
3,182,257 A * 5/1965 Linkowski ..... G01R 1/06788 324/149
3,842,394 A * 10/1974 Bolduc ..... A61B 5/0416 439/261
4,243,285 A * 1/1981 Crowley ..... H01R 13/35 439/219
4,700,997 A * 10/1987 Strand ..... A61B 5/0416 439/370
5,928,022 A * 7/1999 Moeller ..... H01R 11/22 439/197

FOREIGN PATENT DOCUMENTS

GB 914670 A * 1/1963 ..... H01R 11/24

* cited by examiner

*Primary Examiner* — Travis S Chambers
(74) *Attorney, Agent, or Firm* — Galgano IP Law PLLC; Thomas M. Galgano

(57) ABSTRACT

A protective housing for an alligator clip and the ends of electrical cables used for high amperage applications, which includes a relatively rigid, non-electrically conductive hollow housing defining an interior chamber configured and dimensioned to accommodate and fully enclose an alligator clip therewithin and having openings at opposite ends thereof which open onto the interior chamber therein to allow and accommodate one or more electrical cables to be inserted into and through the openings of the opposite ends of the housing to permit coupling thereof within the housing chamber with the alligator clip. The hollow housing is openable to allow for insertion and removal of an alligator clip and has an opening therethrough communicating with the internal chamber thereof. A non-electrically conductive button movably is mounted in the opening in the housing for reciprocal movement generally into and out of the chamber for opening and closing the alligator clip.

22 Claims, 4 Drawing Sheets

SAFETY HOUSING FOR ALLIGATOR CLIP USED IN HIGH AMPERAGE ELECTRICAL APPLICATIONS

BACKGROUND OF THE INVENTION

1. Field of the Invention

The invention relates to the field of safety or protective housings, shrouds, or casings for electrical connectors used in high amperage electrical applications. More particularly, the present invention relates to a protective insulated housing for high amperage alligator clip terminals used in applications up to 75 amperes which encloses the alligator clip and the live ends of an electrical cable connected to the alligator clip to protect the user from unintentional shocks and the electrical system being monitored or tested from unwanted electrical contacts between the clip terminals.

2. Description of Related Art

Alligator clips, also known as crocodile clips, are metal clips with spring-loaded jaws used, inter alia, for creating a temporary electrical connection. Specifically, the clips are widely used as easily attachable and detachable connectors for a variety of electrical applications. They are typically attached to an electrical system as an extension of the electrical circuit. Conventional alligator clips used in the electrical field typically have two clip members pivotally connected together, each of which have a serrated jaw at one end which are forced together by a spring. Consequently, the spring-loaded serrated jaws are normally closed due to the biasing force of the spring but they open when a greater force is applied to pivotally move the jaws apart. These clips are presently available and marketed and sold in various sizes and shapes depending on the electrical strength (e.g., amperage) at which they are used. The purpose for which they are employed can also impact the type of material from which they are fabricated, which should, however, always be of a conductive nature.

Currently, the alligator clips are often sold with a plastic or rubber barrel-shaped protective shroud or boot which covers the body of the alligator clip, but which are typically tapered but not closed at the cable extremities to tightly hold the clip jaws which protrude beyond the open end of the boot. The boot acts as a cup-shaped shroud or conical cover around the clip and is intended to protect the users from contacting the metal surfaces. These boots are, however, weak and slippery. Since they are typically opened at one end, they do not fully encompass the alligator clip or the ends of the live cables to which the alligator clip is temporarily and releasably attached. The boots are unreliable and sometime move during application. These two weaknesses can lead to electrical shorts and arcing which can be hazardous especially for applications at high amperage, such as test rigs.

It is therefore an object of the present invention to provide a protective housing for alligator clips operating in high amperage applications which fully encloses the alligator clip which prevents the two live electrical connector ends from contacting each other and which serves to protect and minimize the possibility of the user being subject to an electrical shock hazard.

It is yet another object of the current invention to provide such a housing made of non-conductive plastic material can be used in high voltage and amperage applications, which allows for flame retardancy, and which prevent electrical arcing.

It is a further object of the invention to provide a protective housing which is easy to use and includes a button which allows the user to open the alligator clip in an easy and facile manner and without risking contact with the electrically "live" components.

It is yet another object of the current invention to provide such a housing which is durable and does not need to be replaced frequently.

SUMMARY OF THE INVENTION

Certain of the foregoing related objects are readily attained according to the invention by the provision of a protective housing for an alligator clip and the ends of electrical cables used for high amperage applications, comprising a relatively rigid, non-electrically conductive, hollow housing defining an interior chamber configured and dimensioned to accommodate and fully enclose an alligator clip therewithin and having opposite ends with openings which open onto the interior chamber therein to allow and accommodate at least one electrical cable to be inserted into and through the openings of the opposite ends of the housing to permit coupling thereof within the housing chamber with the alligator clip. The hollow housing is openable to allow for insertion and removal of an alligator clip and has an opening therethrough communicating with the internal chamber thereof. A non-electrically conductive button is movably mounted in the opening in the housing for reciprocal movement generally into and out of the chamber for opening and closing the alligator clip.

Preferably, the protective housing is a two part housing comprising a generally cylindrical part and a generally conical part releasably secured together and includes means for releasably securing the house parts together. Desirably, the safety housing additionally includes a generally cylindrical sleeve coupled to one end of the housing which has two opposite ends and an internal passageway extending therethrough from one end to the other and wherein the sleeve passageway is configured and dimensioned to accommodate at least one electrical cable therein. Most desirably, the sleeve has a coil-like section to permit bending thereof.

In a preferred embodiment of the invention, the interior chamber is generally rectangular and the said button is generally rectangular. Advantageously, the interior chamber is configured and dimensioned to be slightly larger than the alligator clip intended to be disposed therein. Most advantageously, the openings of the housing are each configured and dimensioned to accommodate a predetermined number of electrical cable ends and prevent larger unwanted objects from entering the openings. Desirably, the safety housing includes means for supporting an alligator clip in the housing. Most desirably, the means for supporting comprises a terminal attachable to an alligator clip.

Certain of the foregoing and related objects are also attained in an alligator clip assembly comprising an alligator clip, a relatively rigid, non-electrically conductive, hollow housing defining an interior chamber configured and dimensioned to accommodate and fully enclose the alligator clip therewithin and having opposite ends with openings which open onto the interior chamber therein to allow and accommodate at least one end of an electrical cable to be inserted into and through the openings of the opposite ends of the housing to permit coupling thereof within the housing chamber with the alligator clip, with the hollow housing being openable to allow for insertion and removal of the alligator clip and said hollow housing having an opening therethrough communicating with the internal chamber thereof. The assembly further includes a non-electrically conductive button movably mounted in the opening in the housing for reciprocal movement generally into and out of the chamber for opening and closing the alligator clip. This embodiment may also optionally include the other features of the safety housing described above.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

DETAILED DESCRIPTION OF THE PREFERRED AND ILLUSTRATED EMBODIMENT

Figure 1:
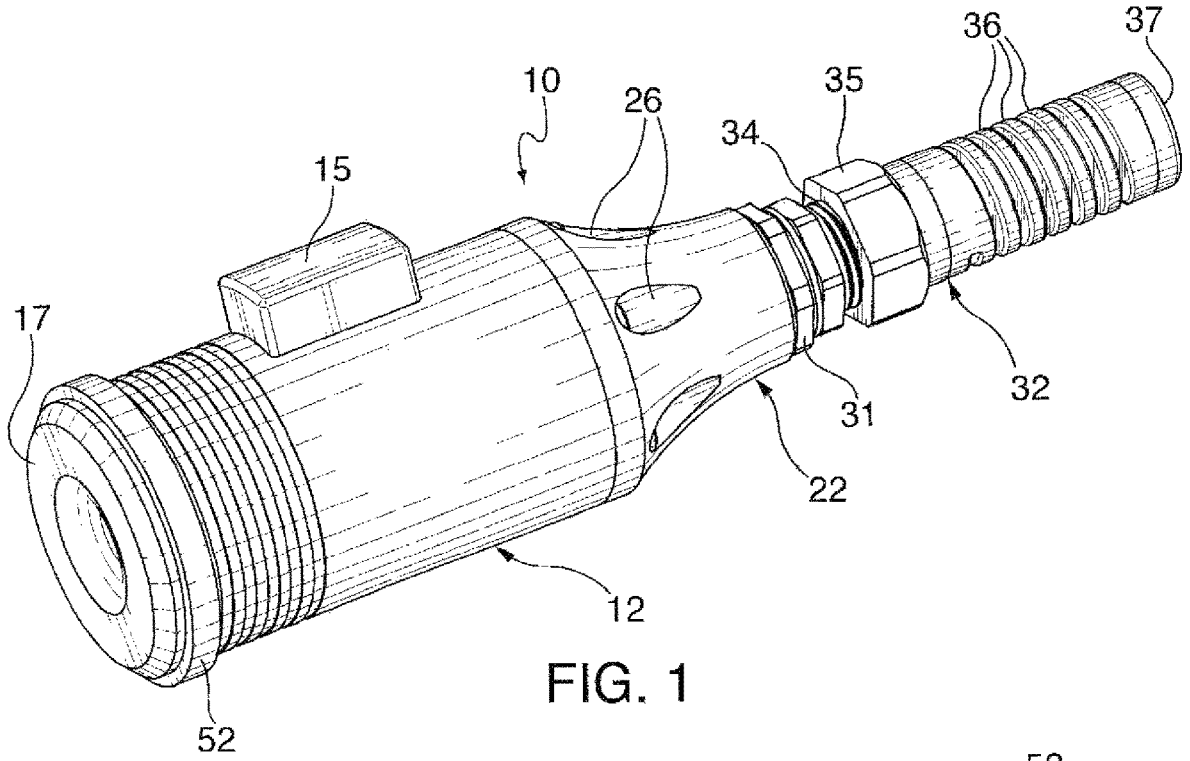
FIG. 1 is a front, top, and side perspective view of a protective housing assembly for an alligator clip embodying the present invention.
Figure 2:
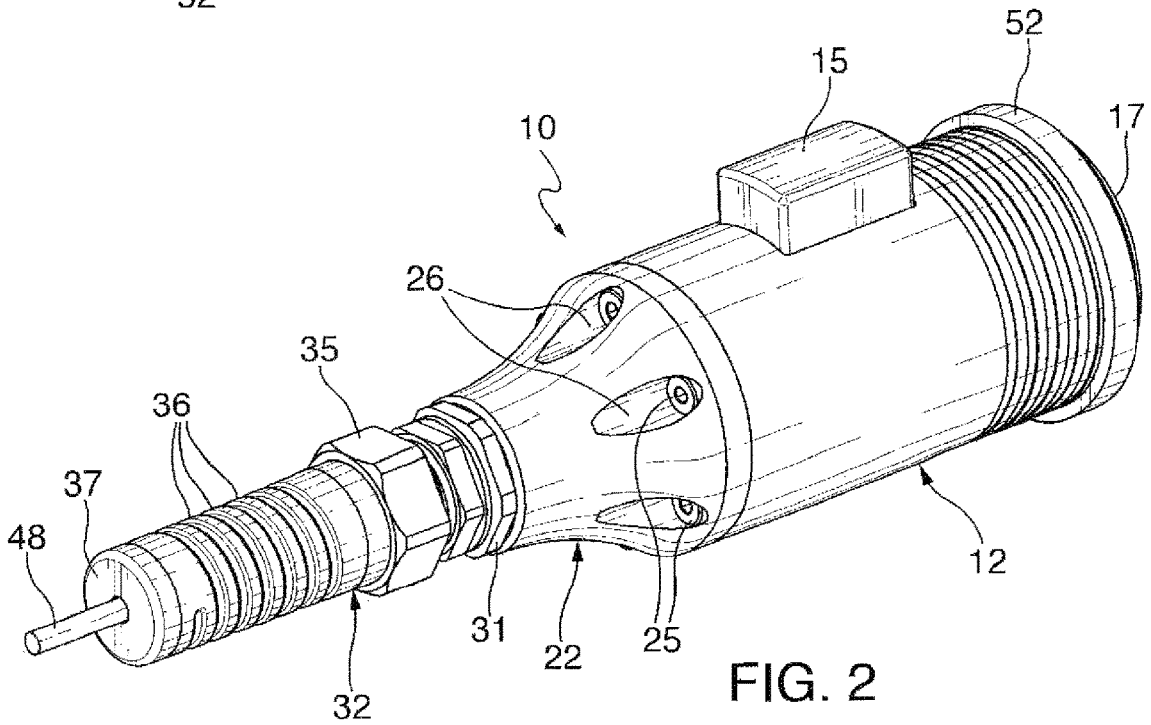
FIG. 2 is a rear, top and side perspective view of the housing assembly shown in FIG. 1.
Figure 3:
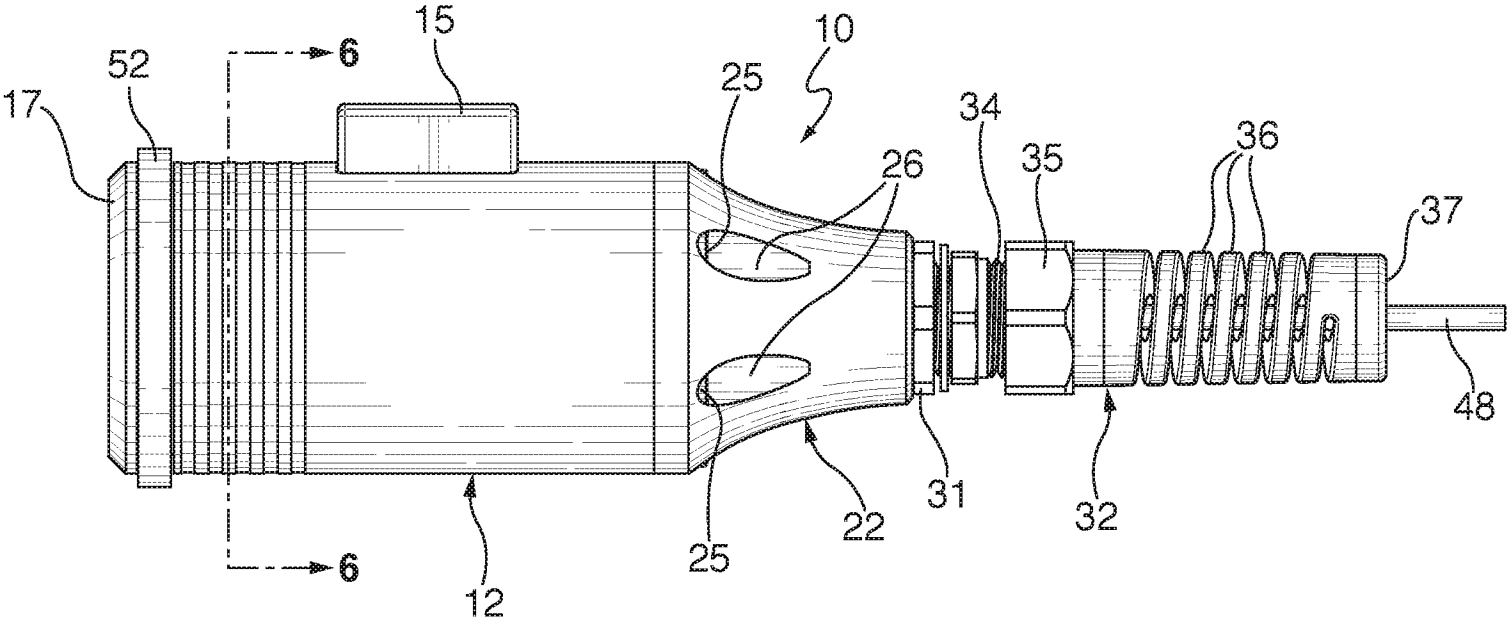
FIG. 3 is a side elevational view of the housing assembly shown in FIG. 1.
Figure 4:
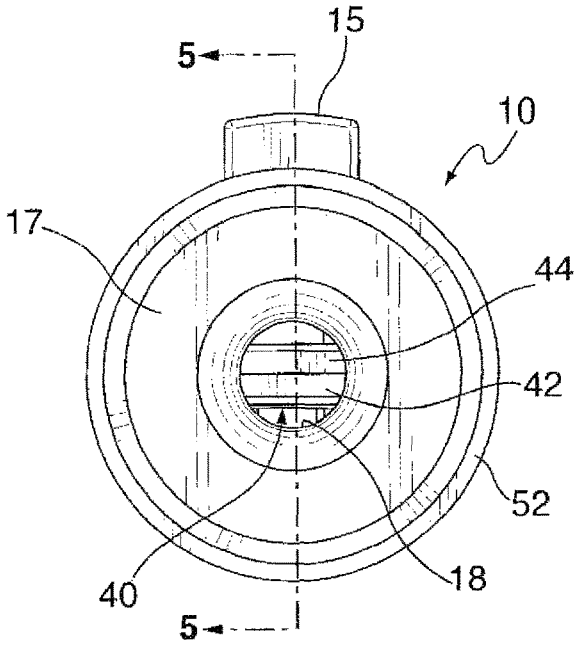
FIG. 4 is a front end view of the housing assembly shown in FIG. 1.
Figure 6:
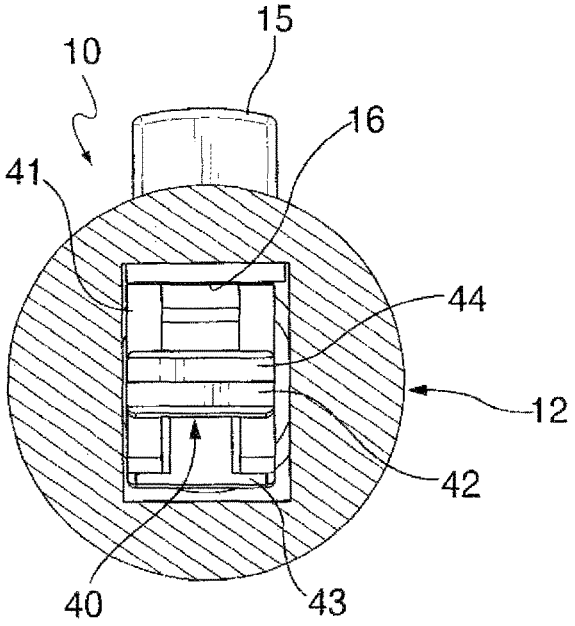
FIG. 6 is a sectional view taken along line 6-6 of FIG. 3.
Figure 7:
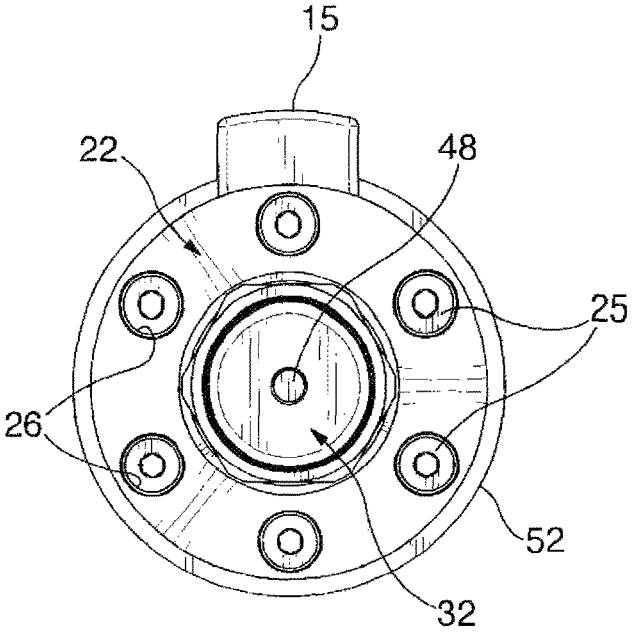
FIG. 7 is a rear end view of the housing shown in FIG. 1.

Referring now in detail to FIGS. 1-7 and, in particular, FIGS. 1-3 of the drawings, therein illustrated is a novel safety or protective housing assembly for an alligator clip embodying the present invention generally identified by reference numeral 10. Housing 10 is preferably made of rigid, nonconductive material such as a synthetic plastic material. Housing 10 includes a generally cylindrical hollow front housing 12 detachably coupled to a hollow generally conical rear housing 22 which, in turn, is optionally detachably coupled to a cylindrical sleeve 32.

Front cylindrical housing 12 and rear conical housing 22 each have inside surfaces which together define a central, preferably rectangular, interior cavity or chamber 14 extending through both housing parts 12, 22. As seen best in FIGS. 5A and 5B, cylindrical front housing 12 has an annular, planar outer front end face 17 which defines a circular opening or inlet 18 which opens into rectangular cavity 14. It also has an inner, annular, planar rear end face 13 which abuts the likewise inner annular planar end face 23 of a radially outwardly-extending annular flange 24 of conical rear housing 22. Front cylindrical housing 12 serves to protect the connection between an alligator clip 40 received in rectangular chamber 14 and the end of at least one cable 47 inserted through opening 18 (FIG. 5B). Conical housing 22 serves to protect the connection between the alligator clip 40 and the wire(s) 47 of the electrical system to which it connects. Advantageously, the inlet is dimensioned and configured to be large enough to allow insertion of the live end of one or more desired cables 47 (only one of which is shown) but yet sufficiently small enough to restrict the penetration of unwanted other cables or foreign objects from entering housing 10. Generally, the size of the opening 18 is not much larger than the width of the jaws 42, 44 of the alligator clip 40 when opened.

Annular rear end face 13 of front housing 12 has a plurality of internally-threaded blind bores 19 formed therein in a radially-spaced apart manner about its periphery. Similarly, annular inner end face 23 of flange 24 of rear housing 22 has a plurality of internally-threaded throughbores 21 extending therethrough arranged in a similar radially-spaced-apart manner about its periphery which are sized and disposed so that each throughbore 21 in said rear housing 22 aligns and registers with a different one of said blind bores 19 in the cylindrical front housing 12. As a result, a plurality of bolts or screws 25 can each be threadably inserted into one of the throughbores 21 and its paired aligned blind bore 19 to securely join the two housing parts 12, 22 together. Rear conical housing 22 is preferably provided with scalloped cut outs 26 in its conical outer surface to facilitate access to said screws 25 and screw holes 19 to allow for easy and facile assembly and disassembly of said housings 12, 22, as seen best in FIGS. 5A and 5B.

As further seen in FIGS. 1-3, 5A and 5B, elongated generally cylindrical sleeve 32 has an externally threaded front end portion 34 which is threadably receivable in the circular bore or port 28 defined by the internally threaded cylindrical rear end portion 29 of conical housing 22. It also has a hexagonally-shaped, nut-like external surface 35 on a middle segment thereof to facilitate the rotation and the threaded cylindrical coupling of cylindrical sleeve 32 via its externally-threaded front end 34 to rear housing 22 aided by nut 31 to releasably lock the front end portion 34 and, in turn, cylindrical sleeve 32 in rear end portion 29. Cylindrical sleeve 32 also has a helical coil-like section 36 adjacent its rear end 37 to facilitate bending thereof, and a generally cylindrical channel 38 extending therethrough from its front end 34 to its rear end 37 which is of sufficient size to allow one or more wires or cables 48 (only one of which is shown) of the system to be inserted therethrough and attached to the rear end of the alligator clip 40, but which is small enough to prevent further unwanted cables from entering channel 38. As illustrated, cylindrical sleeve 32 has an internal channel 38 and rear opening sized to accommodate only one cable 48 whereas opening 18 is sized to accommodate a plurality of cables 47. However, the sizes of both can also be made larger to accommodate a larger front opening 18 and channel 38 and its rear opening can be enlarged or made smaller as desired.

Figure 5A:
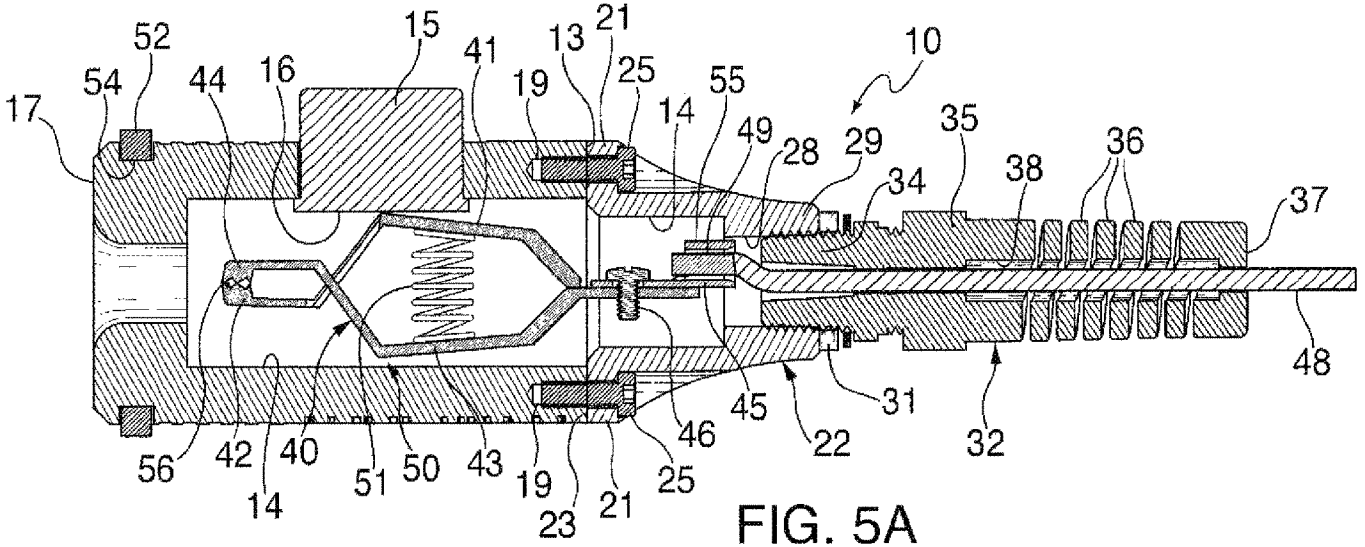
FIG. 5A is a cross-sectional view of the housing assembly taken along lines 5-5 of FIG. 4, showing the position of the alligator clip in its non-operative position.
Figure 5B:
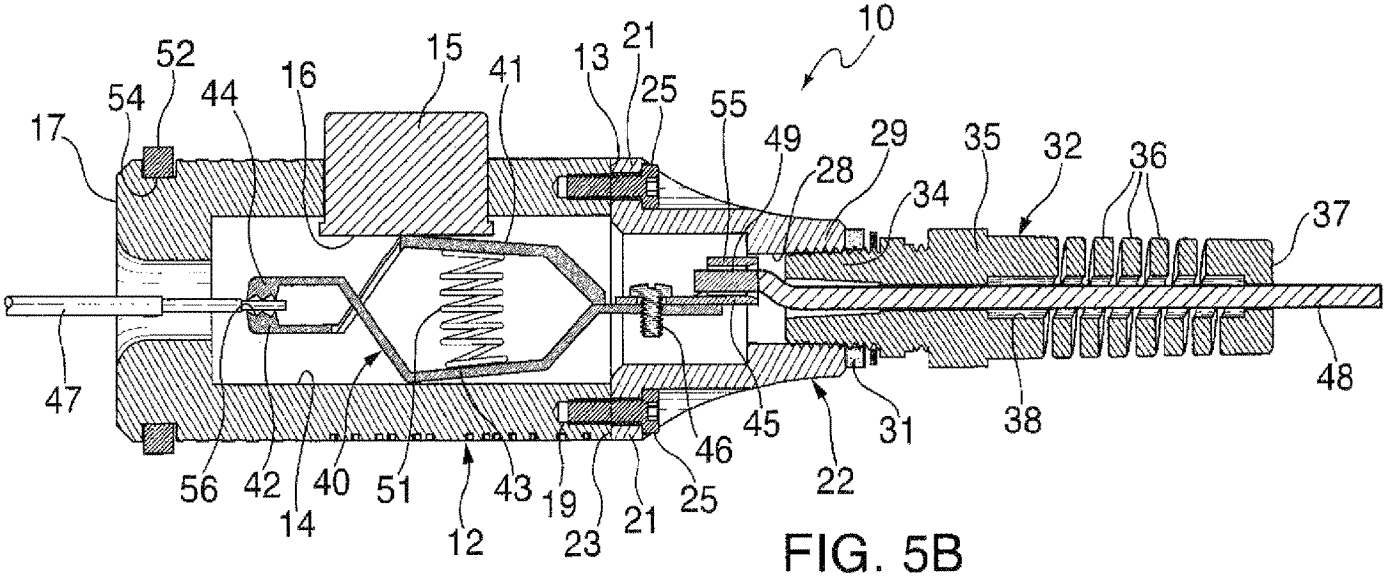
FIG. 5B is a cross-sectional view of the housing assembly taken along line 5-5 of FIG. 4, but showing the position of the alligator clip in its operative position grasping an end of an electrical cable with its serrated jaws.

As seen best in FIGS. 5A and 5B, front cylindrical housing 12 has a generally rectangular opening in its cylindrical wall in which is mounted a rectangular button 15 for slidable and reciprocal up-and-down movement between a non-operative position, in which its lower flanged inner end 16 abuts the inner surface of the cylindrical wall of housing 12 which defines chamber 14 and the upper arm 41 of alligator clip 40 (FIG. 5A), and an operative position, in which it is pressed downwardly or radially inwardly from the inner surface of the cylindrical wall defining interior chamber 14 of front housing 12 (FIG. 58) manually by the user, to in turn press against upper arm 41 of alligator clip 40 to open its jaws as described in greater detail hereinafter.

An alligator clip 40 designed and rated for application to electrical circuits of up to 75 amperes is removably mounted in chamber 14. An end of one or more desired cables 47 can be inserted into circular opening or inlet 18 provided at the front end 17 of the housing 12. It can be observed from FIG. 4, that the opening 18 is directly aligned along the axial axis of housing 10 and provides a direct and straight access to the jaws 42, 44 of the alligator clip 40.

The placement, installation and operation of the alligator clip 40 in the interior chamber 14 of housing 10 is best seen in FIGS. 5A and 5B. The upper arm 41 of the clip 40 is connected to the lower jaw 42 and rests against the inner or bottom surface 16 of button 15. The lower arm 43 of the clip 40, which is connected to the upper jaw 44, is disposed above and spaced above the inner surface of the cylindrical housing 12 defining chamber 14 in order to provide a tolerance gap or space 50 which ensures that the jaws 42, 44 of the clip 40 are normally in their closed position, when the alligator clip 40 is in its non-operative state, with its coil spring 51 biasing its jaws 42, 44 shut. The width and height of interior chamber 14 is selected to be slightly larger than the dimensions of the alligator clip 40 to allow a sliding fit and to prevent radial displacement of its arms 41, 43 and jaws 42, 44 when so mounted therein. Likewise, axial movement toward the front end 17 of the housing 10 is prevented by the electrical wire or cable 48 which is snugly, and tightly installed in the non-conductive cylindrical sleeve 32 to restrain movement of the alligator clip 40. Here too, the center passageway 38 of cylindrical sleeve 32 is configured and dimensioned to only allow one or more desired electrical wires or cables 48 therethrough. Another means used to prevent axial movement is a terminal 45 attached to the end of the alligator clip 40 by means of a screw 46 and terminal 45 also serves to grip, via its sleeve-like rear end 55, the bare end(s) 49 of one or more wires or cables 48. The inner end portion of wire or cable 48 is itself held in place by the inner end portion of sleeve 32 which also protects it from bending. As the arms 41, 43 of alligator clip 40 are generally planar or flat, the alligator clip itself cannot rotate on itself due to its shape, as further aided by the lower planar wall of the rectangular interior chamber 14 against which lower arm 43 of clip 40 abuts when button 15 is depressed. Moreover, the interior chamber 14 is larger than the clip 40, but not large enough to permit axial movement of clip 40. The clip 40 is blocked from sliding by the electrical wire or cable 48 and by the conical part 22 of the housing. In addition, to protect the assembly from impacts, since the wires or cables 47 can be attached as a bundle, a rubber O-ring 52 is installed in a groove 54 extending about the circumference of the front end of the cylindrical housing 12.

Before operation or for maintenance, the user opens the two housings 12, 22 by removing the screws 25, installs the alligator clip 40 and attaches it to the electrical wire or cable 48. The housings 12, 22 are then re-attached and re-sealed via screws 25. The user then pushes down button 15 manually with sufficient force to overcome the spring force and compress the arms 41, 43, via the lower flanged inner end 16 of button 15 which presses arm 41 downwardly so that, in turn, arm 43 abuts chamber wall 14 to eliminate space 50 thus pivoting the jaws 42, 44 of the alligator clip 40 into an open position. As shown in FIG. 58, as jaws 42, 44 are opened the end of a wire or cable 47 can be inserted via opening 18 into and between the jaws 42, 44. The operator can then release button 15 which, in turn, allows the jaws 42, 44 of the alligator clip 40 to close around and tightly grip the free end of wire or cable 47 with their serrated teeth 56, to maintain an electrical connection to wire or cable 47 and, at the same time, causing the upper arm 41 to move upwardly under the spring force which, in turn, engages and moves button 15 to its original and normal inoperative position shown in FIG. 5A.

While particular embodiments of the invention have been described, it is not intended that the invention be limited thereto, as it is intended that the invention be as broad in scope as the prior art will allow and that the specification be read likewise. For example, while it is preferable that the housing be split in two parts, depending on the particular application, they could be split transversely as shown or longitudinally. Moreover, the housing could possibly be openable in another manner to provide access to the interior chamber which, as a practical manner, is necessary to enable insertion and removal of the alligator clip and other components into the interior chamber of the housing.

Furthermore, the external configuration of the housing need not be cylindrical and/or conical as long as the clip contained therein does not move and is held in a fixed position therein. Similarly, the shape of the button 15 can vary as desired. It should also be noted that although the drawings show the openings as accommodating only a single cable at both ends, the cable for high voltage or high amperage application are usually much larger. In addition, as previously mentioned, the openings can be larger to accommodate a number of cables, but also be sized to prevent larger or other unwanted objects from entering the openings. It will therefore be appreciated by those skilled in the art that other modifications could be made thereto without departing from the spirit and scope of the invention.

We claim:

1. A protective housing for an alligator clip and the ends of electrical cables used for high amperage applications, comprising:

a relatively rigid, non-electrically conductive hollow protective housing defining an interior chamber configured and dimensioned to accommodate and fully enclose an alligator clip therewithin and having a front and a rear end, each having an opening which opens onto said interior chamber therein to allow and accommodate an electrical cable to be inserted into and through each of said openings of said front and rear ends of said protective housing to permit coupling thereof within said protective housing interior chamber with the alligator clip, said protective housing being openable to allow for insertion and removal of an alligator clip and having an opening therethrough communicating with said interior chamber thereof; and a non-electrically conductive button movably mounted in said opening in said protective housing for reciprocal movement generally into and out of said interior chamber for opening and closing the alligator clip.

2. The protective housing according to claim 1, wherein said protective housing is a two part housing comprising a generally cylindrical part and a generally conical part releasably secured together and includes means for releasably securing said housing parts together.

3. The protective housing according to claim 1, wherein said interior chamber is generally rectangular.

4. The protective housing according to claim 1, wherein said button is generally rectangular.

5. The protective housing according to claim 1, wherein said interior chamber is configured and dimensioned to be slightly larger than the alligator clip intended to be disposed therein.

6. The protective housing according to claim 1, wherein said openings of said housing are each configured and dimensioned to accommodate a predetermined number of electrical cables and prevent larger unwanted objects from entering said openings.

7. The protective housing according to claim 1 additionally including a generally cylindrical sleeve coupled to said rear end of said protective housing and which has two opposite ends and an internal passageway extending therethrough from one end to the other end thereof and wherein said sleeve passageway is configured and dimensioned to accommodate therein an end of the electrical cable insertable into and through said opening of said rear end of said protective housing.

8. The protective housing according to claim 7, wherein said sleeve has a coil-like section to permit bending thereof.

9. The protective housing according to claim 1, additionally including means for supporting an alligator clip in said housing.

10. The protective housing according to claim 9, wherein said means for supporting comprises a terminal attachable to the alligator clip.

11. An alligator clip assembly comprising:

an alligator clip;

a relatively rigid, non-electrically conductive hollow protective housing defining an interior chamber configured and dimensioned to accommodate and fully enclose said alligator clip therewithin and having a front end and a rear end, each having an opening which opens onto said interior chamber therein to allow and accommodate one end of an electrical cable to be inserted into and through said openings of said front and rear ends of said protective housing to permit coupling thereof within said housing interior chamber with said alligator clip, said protective housing being openable to allow for insertion and removal of said alligator clip and having an opening therethrough communicating with said internal chamber thereof, and a non-electrically conductive button movably mounted in said opening in said protective housing for reciprocal movement generally into and out of said chamber for opening and closing said alligator clip.

12. The alligator clip assembly according to claim 11, wherein said interior chamber is generally rectangular.

13. The alligator clip assembly according to claim 11, wherein said button is generally rectangular.

14. The alligator clip assembly according to claim 11, wherein said interior chamber is configured and dimensioned to be slightly larger than said alligator clip disposed therein.

15. The alligator clip assembly according to claim 11, wherein said openings of said front and rear ends of said protective housing are each configured and dimensioned to accommodate a predetermined number of electrical cables and prevent larger unwanted objects from entering said openings.

16. The alligator clip assembly according to claim 11, wherein said protective housing is a two part housing comprising a generally cylindrical part and a generally conical part releasably secured together and includes means for releasably securing said housing parts together.

17. The alligator clip assembly according to claim 16, wherein said cylindrical part has a rear end, and said conical part has a front end which are releasably secured together by said means for releasably securing.

18. The alligator clip assembly according to claim 17, additionally including a generally cylindrical sleeve coupled to said rear end of said protective housing and which has two opposite ends and an internal passageway extending therethrough from one end to the other end thereof and wherein said sleeve passageway is configured and dimensioned to accommodate therein an end of the electrical cable insertable into and through said opening of said rear end therein.

19. The alligator clip assembly according to claim 11, additionally including a generally cylindrical sleeve coupled to said rear end of said protective housing and which has two opposite ends and an internal passageway extending therethrough from one end to the other end thereof and wherein said sleeve passageway is configured and dimensioned to accommodate passage therethrough of an end of the one electrical cable insertable into and through said opening of said rear end of said protective housing.

20. The alligator clip assembly according to claim 19, wherein said sleeve has a coil like section to permit bending thereof.

21. The alligator clip assembly according to claim 11, additionally including means for supporting said alligator clip in said protective housing.

22. The alligator clip assembly according to claim 21, wherein said means for supporting comprises a terminal to which said alligator clip is attached.

* * * * *